United States Patent [19]

Brotzmann et al.

[11] 4,356,035

[45] Oct. 26, 1982

[54] STEELMAKING PROCESS

[75] Inventors: Karl Brotzmann; Paul Mantey, both of Sulzbach-Rosenberg, Fed. Rep. of Germany

[73] Assignee: Eisenwerk-Gesellschaft Maximilianshütte, Sulzbach-Rosenberg, Fed. Rep. of Germany

[21] Appl. No.: 214,844

[22] Filed: Dec. 10, 1980

[30] Foreign Application Priority Data

Dec. 11, 1979 [DE] Fed. Rep. of Germany ..... 2951156
Mar. 4, 1980 [DE] Fed. Rep. of Germany ..... 3008145

[51] Int. Cl.[3] ..... C21C 5/32; C21C 5/34

[52] U.S. Cl. ..... 75/52; 75/59; 75/60

[58] Field of Search ..... 75/52, 59, 60

[56] References Cited

U.S. PATENT DOCUMENTS

| | | | |
|---|---|---|---|
| 3,854,932 | 12/1974 | Bishop | 75/60 |
| 3,953,199 | 4/1976 | Michaelis | 75/60 |
| 4,089,677 | 5/1978 | Spenceley | 75/60 |
| 4,178,173 | 12/1979 | Gorges | 75/60 |
| 4,195,985 | 4/1980 | Brotzmann | 75/60 |
| 4,198,230 | 4/1980 | Brotzmann | 75/60 |

*Primary Examiner*—P. D. Rosenberg
*Attorney, Agent, or Firm*—Lawrence I. Field

[57] ABSTRACT

Oxygen is introduced onto the surface of a molten ferrous metal through at least one water-cooled lance disposed above the melt surface while an oxygen free gas in which is entrained ground solids is intermittently introduced into the molten ferrous metal through tuyeres disposed below the melt surface.

11 Claims, 1 Drawing Figure

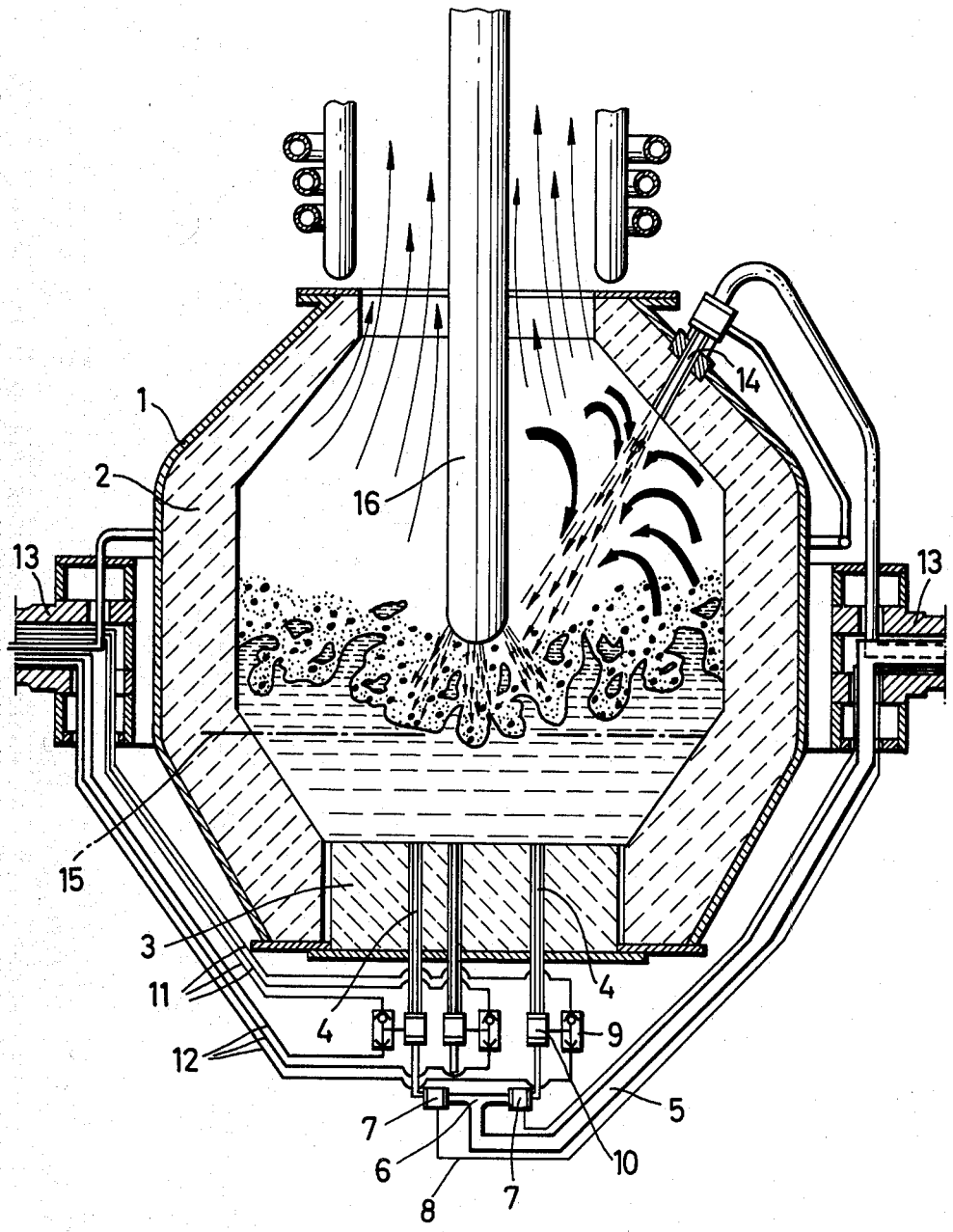
1
2
13
13
14
16
15
3
11
12
4
4
9
5
7
6
8
7
10

STEELMAKING PROCESS

The invention relates to a steelmaking process in a converter equipped with tuyeres located—when the converter is in the blowing position—underneath the steel bath surface and with a water-cooled lance and/or top-blowing tuyeres in the upper region of the converter lining.

There is world-wide use of the oxygen-refining method for steelmaking by the top-blowing and blow-through process with tuyeres consisting of two concentric pipes for the oxygen and a protective medium located underneath the bath surface, for instance in the converter bottom. Today the further development aims at increasing the economy by improving the yield and decreasing the amounts of admixtures (slag forming agents) and media (oxygen and coolant). Another approach is to increase the proportion of scrap as far as the exclusive use of scrap and to apply the required energy to the melt in the form of fuels with the highest possible caloric efficiency.

Various solutions have been proposed in recent times to that end. In one of these methods the scrap first is preheated in the converter, and thereupon carbonaceous powdery fuels are fed into the melt to supply further energy.

In another method to increase the scrap proportion, part of the oxygen is blown through the bath and 20 to 80% of the total amount of oxygen are blown in free-jet form on the melt. It is furthermore known to subject the carbon monoxide leaving the melt to post-combustion.

In another method for steelmaking in the converter, heat is fed to the melt by carbonaceous fuels. The carbon-containing fuels are introduced into the melt while simultaneously the oxygen to refine the melt and to burn the fuels is introduced by gas jets directed on the bath surface and into the converter underneath the bath surface. This method offers a particular advantage in that the fuels introduced are burned at a high caloric efficiency of about 30% as regards the combustion to carbon dioxide. The high degree of energy utilization is achieved by supplying oxygen onto the bath surface and the related heat supply from the CO after-combustion to the melt.

The known method furthermore permits a decrease in the number of tuyeres below the bath surface; this entails further advantages in steelmaking. However one drawback of the known method is that under given operational conditions, the blow-in rate of the carbonaceous fuels is markedly increased on account of the restricted blowing cross-section of the few tuyeres below the bath surface, and hence limits are encountered as regards the simultaneous supply of fuel and oxygen.

The drop in the refining effect at low carbon contents is known to be a drawback in the oxygen topblowing method without a refining gas supply underneath the bath surface. For instance for a melt carbon content less than 0.1% the decarburization rate drops appreciably, as the concentration of carbon in the melt falls due to the lower formation of CO bubbles. The iron oxide content in the melt rises concurrently. The drop in the decarburization rate results in an extension of the refining time, and the increased iron oxide in the slag amounts to a loss. Both the extension in the refining time and the drop in yield adversely affect the economy.

The oxygen blow-through method, which is free from these drawbacks, however in the present state of the art does require at least one change of bottom during the operational life of a converter lining. The refractory material in the region of the oxygen tuyeres in the converter bottom wears at approximately twice the rate of wear of the lining of the converter wall. Besides the expenses for the refractory material, there is also a loss in labor time of about 20 hours' production for changing the bottom.

The above cited methods comprise partial solutions for the said drawbacks of the oxygen top-blowing and through-blowing process and show how to increase the heat supply when making steel in converters. When oxygen is blown below and on top of the bath surface into the melt, there result—besides the shortcomings of costly installation for the oxygen supply below and above the bath surface—undesirably high contents in hydrogen and nitrogen from the tuyere protective means below the bath surface at least as regards certain steel grades. The dephosphorization also is less during decarburization as compared with the oxygen topblowing method.

It is therefore the object of the invention to combine the advantages of a particular slagging procedure similar to the oxygen topblowing method but without increased iron losses in the slag and the advantages of the oxygen blow-through method, in particular regarding the low final carbon contents, and further to achieve low hydrogen and nitrogen contents in the steel. Also, high caloric efficiency will be obtained when blowing carbonaceous fuels into the melt and the life of the refractory lining in the vicinity of the tuyeres (converter bottom) below the bath surface will be improved.

Lastly it shall be possible to blow relatively large amounts of carbonaceous fuels through the converter bottom even when only a few tuyeres are present.

The above object is solved by the invention in that the oxygen is fed by a water-cooled lance and/or at least one topblowing tuyere in the upper converter lining directed on the bath surface, and in that ground solids for the purpose of slag formation and/or heat supply are introduced at least part of the time in suspension in an oxygen-free gas into the melt below the bath surface through the double-pipe tuyeres operating with a protective medium.

Now it was surprisingly found that blowing oxygen-free gases below the bath surface, where said gases are loaded part of the time with ground solids for the purpose of slag formation, and together with which pulverized fuels containing carbon, for instance coke, are also being introduced, represent adequate converter steelmaking steps with good results, such as are known from the oxygen blow-through process. In particular low carbon contents, which can be easily controlled, can be met without incurring higher losses in iron in the slag. For instance it was possible to achieve carbon contents of 0.03% for iron oxide contents of about 12% in the slag. As regards the oxygen topblowing method, the iron oxide contents already are about 25% when the carbon in the steel is only about 0.05%.

In conformity with the invention, less than half the tuyeres otherwise required in the oxygen blowthrough method are installed below the bath surface in the converter bottom and/or the lower sidewall. Ordinarily the conventional tuyeres consisting of two pipes are used. In special cases annular gap tuyeres per German Pat. No. 24 38 142 can be used, i.e. tuyeres made from three concentric pipes may be used. These three-pipe tuyeres provide two about equally large annular gaps of about 0.5 to 2 mm wide. A suspension of solids and inert gas passes through the central pipe of the three-pipe tuyere, while oxygen passes through the annular gap surrounding the innermost pipe and hydrocarbons pass through the outer gap, all said substances passing into the melt. The proportion of hydrocarbons to protect the tuyeres is slight and ordinarily amounts to 0.1 to 5% referred to the amount of carrier gas in the central pipe. The proportion of oxygen in the annular gap corresponds at least to that of the hydrocarbons. Also, an inert gas such as argon or another gas free of nitrogen and free of hydrogen may be fed through all three tuyere passages during the last refining phase.

The term bath denotes that converter volume which is assumed by the final-refined, resting steel melt in the converter blowing position. Accordingly the bath surface is the surface of that melt.

In case scrap is preheated in the converter, for instance when producing a steel melt from solid iron carriers, the tuyeres in the region of the steel bath serve as oil/oxygen burners to preheat the scrap. As soon as there is a melt in the converter, these tuyeres are used to introduce carbonaceous fuels and slag forming agents.

The tuyeres below the bath surface are installed in the process of the invention approximately as in the following illustrative procedure:

During the desiliconization phase, that is during the first 1–2 minutes of the refining time, the tuyeres are used to supply slag forming agents, preferably lime. During the main refining period, which is about the 5 to 10 minutes thereafter, the required amount of carbonaceous fuels, for instance powdery coke or coal, will be introduced through these tuyeres. Extra lime may be added at the same time. For instance two tuyeres can be used to supply coal dust and one or more tuyeres simultaneously can be used to introduce slag forming agents.

In the final refining phase, about the last 2 to 5 minutes, the tuyeres below the bath surface preferably are used only to introduce gases free from hydrogen or nitrogen, with or without a load of slag forming agents.

Such hydrocarbons as natural gas, methane, propane or heating oil have been found effective as tuyere protective media to prevent premature burning back of the tuyeres in the converter lining during the desiliconization and main refining phase. Preferably argon, carbon monoxide and carbon dioxide are used when final-blowing or post-blowing for steel grades with low hydrogen and nitrogen requirements.

In the process of the invention, oxygen may be blown continuously or for a short time through the central pipe of the tuyeres into the bath region, preferably until after-blowing. First this step eliminates undesired clogging and deposits at the tuyere mouths of the tuyere pipes and sets the desired mushroom-shaped deposits at the tuyere mouths to the desired size (approximately 100 mm in diameter). The alternating operation with slag-forming carrier gas, fuel suspensions and oxygen is possible using corresponding reversing valves. The amounts of oxygen blown in below the bath surface are minor and total less than 20% of the overall amount of oxygen.

It is furthermore the sense of the invention as regards the described three-pipe tuyere, for which the central suspension-medium pipe is surrounded by an oxygen annular gap and a second annular gap for hydrocarbons, that the introduction of the slight amount of oxygen be extended up to the after-blowing phase and in special cases is continued during the after-blowing. Even in continuous operation the amounts of transmitted oxygen are small for the three pipe tuyere and altogether amount to about 10% of the total amount of oxygen.

In accordance with the invention, the oxygen is blown on top of the bath surface for the purpose of refining the melt, to after-burn the melt reaction gases and to burn the carbonaceous fuels in the melt. A water-cooled oxygen lance has been found practical to that end, provided that simultaneously oxygen in the form of a free jet be blown through one or more tuyeres in the upper converter side wall onto the bath surface. The distribution of the rates of oxygen between the lance and the topblowing tuyeres can be varied within wide limits. However at least one fourth of the oxygen referred to the total oxygen amount is transmitted through the side wall tuyeres, as long as the lance near the bath surface blows at a distance of about 0.2 to 1.5 m in the bath surface region.

The use of the oxygen lance practically allows active slagging at the onset of refining, probably because the slag is hotter than the iron melt itself where scrap is still dissolving. The slag-forming agents, mainly lime, possibly with addition of fluorspar and/or dolomite, are loaded in part into the converter as lump lime or are deposited in the form of of lime dust into the oxygen of the blowing lance and/or of the sidewall tuyere. Ordinarily about half the required lime is deposited on the bath surface; the remainder is fed through the tuyeres below the bath surface. However, the ratio can be up to $\frac{3}{4}$ one way or the other. Preferably about 10 to 20% of the total amount of lime is loaded as lump lime into the converter. As a result, viscous slags are obtained before tapping, which can be retained more easily in the converter, and a reversion of phosphorus and sulfur from the slag into the steel melt is reliably avoided prior to tapping.

This slag-forming addition technique of the invention, in particular adding lime, below and above the bath surface, causes an early dephosphorization and improved desulfurization of the iron melt. The causality probably is such that the overheated slag on the bath surface and the top-blown oxygen advance the dephosphorization into the actual decarburization phase, and that the lime dust blow through the melt induces intensive desulfurization at relatively high carbon contents, i.e. low oxygen potential of the melt. Lime is fed to the melt during the last minutes of refining of the final refining period through the bottom tuyeres.

In conformity with the invention, the lance distance can be increased after about half the refining time. It is in the sense of the invention to so increase the lance distance, i.e. to keep the lance about 1.50 m or more above the bath surface, that the oxygen jet acts similarly to the free jet from the sidewall tuyere and contributes to the CO after-combustion and the feedback of the generated heat into the melt.

The invention makes it possible in principle without incurring any drawbacks to remove the lance from the converter after about half the refining time and to blow the oxygen on the bath only through one or more sidewall tuyeres.

In special cases, mostly as regards altering existing oxygen blowthrough converters for the process of the invention, and if water-cooled lances cannot be installed, it is possible to operate without water-cooled lances and to install oxygen top-blowing tuyeres in two different planes above the bath surface in the converter lining. The lower installation plane of the side wall tuyeres then is located between about 0.5 to 2 m above the bath surface. The tuyeres also point to the bath surface. One or more sidewall tuyeres can be arranged in this lower installation plane preferably above the converter pivot as seen in the converter blowing position. The tuyeres appropriately take over the described function of the water-cooled lance in the first half of the refining time. The installed position of one or more tuyeres in a second and higher plane in the converter side wall corresponds in its function to the described sidewall tuyeres where a water-cooled topblowing lance is used.

A further variation of the process of the invention permits operating without sidewall tuyeres and with only a water-cooled lance above the bath surface. In that case the lance is located only at the onset of refining during the desiliconization phase in the said slight spacing from the bath surface. Thereafter and about two minutes after the beginning of refining, the moment the decarburization phase starts, or, when carbonaceous fuels are being fed to the melt, the lance distance is increased to more than 1.50 m, preferably more than 2 m above the bath surface. It was found that for this operation there is enough of a path above the melt for the oxygen issuing from the lance orifice to ensure optimal after-combustion of the reaction gas leaving the melt and to feed back the heat gained to the melt. While this procedure somewhat restricts the flexibility of lance control for the refining sequence as compared to the combination of lance and side-tuyeres, on the other hand it also allows achieving the advantages of the process of the invention. No drawbacks materialized regarding the iron slagging and high caloric efficiency of the carbonaceous fuels fed into the melt.

To be capable of feeding high amounts of fuels per unit time into the melt, even when the number of tuyeres below the bath surface is small, the invention comprises supplying the oxygen only part of the time below the bath surface. The high efficiency when energy is supplied by blowing-in carbonaceous fuels will also be achieved when oxygen is fed only part of the time below the bath surface into the melt. Manifestly the part-time introduction suffices to create conditions that favor feeding back the energy, gained when afterburning the exhaust gases in the upper converter space, into the bath. Thus it was found that it is possible during certain refining phases to utilize all the tuyeres below the bath surface for introducing the cabonaceous fuels as a suspension with an oxygen-free carrier. Surprisingly, if so desired there is no need to blow in oxygen below the bath surface up to about half the entire refining time, and no drawbacks concerning the caloric efficiency of the carbonaceous fuels will be incurred.

The total time in which no oxygen is introduced below the bath surface, may consist either of several shorter time segments or it may be interrupted.

The invention includes another characteristic in that the slag-forming agents, preferably lime (CaO) are introduced in powder form below the bath surface through the tuyeres there. The preferred method is to load the powdery lime on the oxygen.

The invention is further described below in relation to non-restrictive examples and in a FIGURE showing a section through the converter.

The converter for the process of the invention consists of a steel plate casing 1 with a refractory lining 2 and an exchangeable bottom 3 in the refractory lining of which are mounted tuyeres 4. The tuyeres 4 are the conventional two concentric pipe OBM tuyeres. Some or all of these bottom tuyeres also may be designed as three-pipe tuyeres.

Illustratively two bottom tuyeres 4 to introduce the dried and pulverulent cabonaceous fuels are used in the converter shown. The suspension of fuel, for instance lignite coke dust, and oxygen-free carrier gas, for instance nitrogen or argon, flows through a manifold line 5 to a T-distributor 6 to the reversing valves 7 and from there to the central pipes of the tuyeres 4. The reversing valves 7 permit supplying alternately the central pipes of the tuyeres 4 with a suspension of fuel and inert gas or only with an oxygen-free gas, in special cases also with oxygen passing through a line 8 into the reversing valves 7. The annular gaps of the tuyeres 4 are fed either with a liquid or a gaseous protective medium. The change from liquid to gaseous medium and vice-versa is implemented by pressure-controlled switching valves 9 which are conventionally integrated in a tuyere connection flange 10. The liquids and gases are supplied to the reversing valve 9 through supply lines 11,12.

Illustratively the bottom tuyeres may be operated as burners to preheat solid iron carriers. Then liquid hydrocarbons, for instance light heating oil, pass through the line 11 and the reversing valve 9 into the tuyere annular gap and oxygen flows through line 8 and reversing valve 7 and the central pipe of tuyere 4 in stoichiometric amounts as regards oil combustion. The moment there is a melt in the converter and it covers the tuyere orifices, the operation switches over to feeding powdery fuels and simultaneously the annular gaps of tuyeres 4 are supplied with gaseous protective media, for instance hydrocarbons such as natural gas or propane. The melt may consist of molten steel or subsequently charged pig iron.

The other bottom tuyeres are of the same design in principle and are used to supply oxygen-free gases which if need be will also be loaded with powdery slag-forming agents, in particular CaO and/or carbonaceous fuels. However all the bottom tuyeres also can be intermittently fed exclusively with a suspension of carbonaceous fuel and an oxygen-free gas.

The slag-forming agent introducing bottom tuyeres—of which only one is shown—are uniformly loaded from a manifold line and a lime distributing means (not shown) with the suspension of gas and CaO. Gaseous hydrocarbons have been found operationally reliable as protective media within the annular gaps, especially when oxygen or oxygenous gases flow for short intervals through the central pipes of the tuyeres. The tuyeres are operated as burners during the preheating of the solid charge materials in the converter.

An oxygen tuyere 14, i.e. a top-blowing tuyere or a side wall tuyere, is located above the converter pivot 13 in the lining 2 of the converter 1. This top-blowing tuyere 14 preferably consists of two concentric pipes, again oxygen flowing through the central pipe and a tuyere protective medium through the annular gap. The discharge orifice of the tuyere 14 at the inside of the converter lining 2 is located at least 2 m above the bath surface 15. In the case shown, this installed height is about 3 m. At least $\frac{1}{4}$ of the total amount of oxygen passes through the sidewall tuyere in the case shown. The oxygen jet leaves the tuyere orifice approximately at the speed of sound and acts as a free jet within the gas space of the converter. Thereby it sucks up a multiple of its own volume of the reaction gases escaping from the melt into the converter space. A substantial proportion of the carbon monoxide of these reaction gases, at least 20% as shown by experience, is after-burned thereby into $CO_2$. The heat generated during the operation being described in almost entirely transmitted into the melt, and no overheating of the lining takes place. The heat-radiation of the high-temperature free jet (estimated to be at about 2,800° C.) manifestly is absorbed by the converter-space gases which are contaminated with dust and droplets of slag and steel.

More oxygen is blown by means of the water-cooled lance 16 on the bath surface. In this instance the lance comprises four discharge orifices. For the procedure shown with lance and side tuyere, the lance is so controlled that at the beginning of the refining it is moved close to the bath surface 15 and that the lance distance is increased with refining time. Regarding the distribution of the oxygen rates, at least 25% of the total amount of oxygen flow through the side tuyere, but preferably from 30 to 50%.

If all of the oxygen is blown solely through the water-cooled lance, the lance distance to the bath surface 15 after the onset of blowing, but at the latest after the desiliconization phase should be at least 1.50 m.

When feeding an oxygen-free gas through the tuyeres 4 below the bath surface with at least part-time loading of powdery solids, it is possible to sustain an adequate motion in the bath, also as refining nears its end, at very low carbon contents, and to eliminate the occurrence of a foaming slag, as in the case of the oxygen topblowing method, and further to avoid a strong increase in the slag iron content. As rough indicative values, when present, the oxygen-free gas below the surface is sufficient in about 10 to 20% of the amount of oxygen.

A 60-ton converter of the type shown in the drawing when newly lined had an inside volume of 55 $m_3$. Five tuyeres were mounted in the bottom on a center strip about 50 cm wide and parallel to the axis of rotation of the converter. Two of these tuyeres were of the triple-pipe type, the inside diameter of the central pipe being 30 mm and the two annular gaps being each 1 mm wide. These two tuyeres were used to feed powdery carbonaceous fuels. The other three tuyeres below the bath surface consisted of two concentric pipes with an inside diameter of 30 mm for the central pipe and an annular gap of 1 mm width. These tuyeres were used to supply oxygen-free gases with or without a load of slag-forming agents and/or cabonaceous fuels. About 27 tons of solid iron carriers, in particular scrap of mixed grade, occasionally also portions of solid pig iron and pre-reduced iron ores were loaded into the converter.

In other experiments, the solid input materials were so preheated that all five tuyeres were operating as burners and that heating oil flowed through the annular gaps at a rate of 100 l/min and the required stoichiometric amounts of oxygen of 200 $Nm^3$/min passed through the central pipes. The preheating times ranged from 1 to 10 minutes.

After loading the scrap and without prior preheating, 40 tons of liquid pig iron at a temperature of 1,300° C. and composed of 4.2% carbon, 0.7% silicon, 0.6% manganese, 0.35% phosphorus and 0.035% sulfur were then charged. Immediately upon righting the converter into the blowing position, 18,000 $Nm^3$/h of oxygen were fed through two sidewall tuyeres mounted about 3 m above the bath surface in the converter lining above the pivot. The side tuyeres were installed in such a position that the gas jets impinged about on the center of the bath surface. As regards the two bottom tuyeres for the fuel supply, 20 $Nm^3$/min of nitrogen, loaded with 300 kg/min of lignite coke dust were fed through the central pipe. Simultaneously 10 $Nm^3$/min of oxygen flowed through the inside annular gap and 1 $Nm^3$/min of propane through the outer annular gap. The other three bottom tuyeres were supplied in the central pipe with a total of 40 $Nm^3$/min of nitrogen and with 1.5 $Nm^3$/min of propane in the annular gap. In lieu of nitrogen, CO, $CO_2$ and such inert gases as argon also were found practical. About 3 tons of lime dust for slag formation in the first blowing phase are added to the nitrogen in the central pipe while the carbonaceous fuels are being supplied. The time of this refining phase was about 10 minutes.

The fuel supply was terminated after this first refining phase, at which the melt carbon content still was about 1.5 to 2%. The central pipes of the tuyeres below the bath surface then were fed with argon at the rate of 70 $Nm^3$/min. After another 5 minutes approximately, the converter was laid over for sample taking. Then an approximately two-minute corrective blowing ensued, during which the tuyeres below the bath surface were fed through the central pipe and the annular gap with argon. CO, $CC_2$ and mixtures of these gases with argon also have been found practical in lieu of argon alone. Approximately 1 ton of lump lime (CaO) were loaded into the converter during this corrective blowing. After a total refining time of 17 minutes, the finished steel melt was tapped off, its composition being 0.03% carbon, 0.1% manganese, 0.020% phosphorus and 0.015% sulfur. The tapping temperature was 1,650° C. and the batch weight was 61 tons.

A 200 ton converter operating by the process of the invention included a water-cooled oxygen lance and two sidewall tuyeres in the converter hood. About 7,000 $Nm^3$ of oxygen are blown during the refining time of about 12 minutes through the oxygen lance as in the oxygen topblowing method, and about 3,000 $Nm^3$ of oxygen through the two sidewall tuyeres, on the bath surface. Eight tuyeres for oxygen-free gas were located below the bath surface. During approximately the first 8 minutes of blowing, a total of about 1,000 $Nm^3$ of nitrogen loaded with a total of 10 tons of lime dust for slag formation and 5 tons of coke dust for 10% scrap enhancement flowed through the tuyeres below the bath surface.

During the stated time, about 40 $Nm^3$ of natural gas were fed through the tuyere annular gaps. 500 $Nm^3$ of argon were introduced in the melt in the last four minutes of blowing through the tuyeres below the bath surface. Without regard to the additionally molten scrap due to the fuel supply (coke dust), the scrap proportion in the procedure described could be increased by 6 tons, corresponding to 3%, with respect to the oxygen topblowing method. Simultaneously the yield was improved by 1.5%. This is due mainly to the low iron oxide content of the slag, namely about 15% rather than 25% in the oxygen topblowing method, and to a lesser iron loss in the waste gas, namely about 0.5% compared to 1.2% in the topblowing method.

Similarly advantageous results could be obtained in the same 12-ton converter when the entire oxygen was fed through the water-cooled lance and when the tuyeres below the bath surface are operated only with a suspension of an oxygen-free carrier gas and slag forming agents or carbonaceous fuels. However compared to the conventional oxygen topblowing method, the lance distance (distance of lance orifice to the bath surface) was raised already shortly after the onset of blowing, about 1 minute later, to about 1.50 m and after another minute to about 2 m.

The improvement in bottom life was found to be a definite advantage of the process of the invention as compared to the oxygen blowthrough method. In the conventional bottom lining of about 1 m thickness, the bottom did not require changing with each converter lining. Most likely the improvement in bottom life is attributable to the lesser number of tuyeres as compared to the oxygen blowthrough process and to the use of oxygen-free gases.

The essential characteristic, to feed oxygen-free gas below the surface, with or without a load of solids (slag forming agents and/or carbonaceous fuels), for instance in a proportion up to about 20% of the total oxygen, or to feed slight amounts of oxygen continuously or discontinuously but not in amounts exceeding 10% of the total quantity of oxygen, results in a series of advantages.

We claim:

1. A process for making steel in a convertor equipped with tuyeres located below the bath surface and with a water-cooled lance and with topblowing tuyeres located above the bath surface which comprises:

introducing the oxygen feed onto the bath surface through said water-cooled lance and by at least one topblowing tuyere pointing at the bath surface, and at least intermittently introducing an oxygen-free gas, loaded at least in part with ground solids for the purpose of slag formation or for the purpose of heat supply or for both purposes, into the melt through the tuyeres located below the bath surface, the amount of oxygen which is introduced through the tuyeres located below the bath surface being less than 10 percent the total oxygen introduced.

2. Process per claim 1, wherein the entire oxygen for refining the melt, to after-burn the melt reaction gases and to burn the carbonaceous fuels in the melt, is blown onto the bath surface.

3. Process per claim 1 or 2, wherein such slag forming agents as CaO, dolomite, fluor spar, calcium carbide or mixtures thereof are introduced through the tuyeres below the bath surface.

4. Process per one of claims 1 through 3, wherein carbonaceous, pulverulent fuels such as coal, coke, coke dust, lignite coke dust, graphite and mixtures thereof are introduced through the tuyeres below the bath surface in suspension with an oxygen-free carrier gas into the melt.

5. Process per one of claims 1 through 4, wherein nirtrogen, carbon dioxide, carbon monoxide, natural gas, methane, propane, inert gases such as argon and mixtures thereof are used as oxygen-free carrier gases for the ground solids introduced below the bath surface.

6. Process per one of claims 1 through 5, wherein part of the time, oxygen, or an oxygenous gas, is blown into the melt below the bath surface.

7. Process per one of claims 1 through 6, wherein oxygenous gases or oxygen, but altogether less than 20% of the total amount of oxygen, are introduced below the bath surface.

8. Process per one of claims 1 through 7, wherein slag-forming agents are loaded in the form of lump lime into the converter or are blown in the form of lime dust onto the bath surface.

9. Process per one of claims 1 through 8, wherein the oxygen is blown onto the bath surface only by means of a water-cooled lance and in that the distance between the lance orifice and the bath surface following the desiliconization phase amounts to at least 1.5 m.

10. Process per one of claims 1 through 9, wherein the oxygen supply to the bath surface is implemented by one or more tuyeres integrated into the converter lining and shielded by a protective medium against premature back-burning, and in that the gas jet issuing from the tuyere orifice behaves over a substantial path as a free jet and sucks up reaction gases from the converter space before impinging on the converter bath surface.

11. Process per one of claims 1 through 10, wherein in the presence of a simultaneous supply of oxygen through a water-cooled lance and one or more topblowing tuyeres pointing at the bath surface, at least one fourth of the total amount of oxygen will be introduced through the topblowing tuyeres.

* * * * *